US010739107B2

(12) United States Patent
Drake

(10) Patent No.: US 10,739,107 B2
(45) Date of Patent: Aug. 11, 2020

(54) FIREARM CHASSIS WITH INTEGRATED RAIL SYSTEM

(71) Applicant: Drake Associates, Inc., Vero Beach, FL (US)

(72) Inventor: Christopher Drake, Vero Beach, FL (US)

(73) Assignee: DRAKE ASSOCIATES, INC., Vero Beach, FL (US)

( * ) Notice: Subject to any disclaimer, the term of this patent is extended or adjusted under 35 U.S.C. 154(b) by 0 days.

(21) Appl. No.: 16/272,836

(22) Filed: Feb. 11, 2019

(65) Prior Publication Data

US 2019/0178608 A1 Jun. 13, 2019

Related U.S. Application Data

(63) Continuation-in-part of application No. 15/873,468, filed on Jan. 17, 2018, now Pat. No. 10,203,178.

(60) Provisional application No. 62/446,898, filed on Jan. 17, 2017, provisional application No. 62/739,673, filed on Oct. 1, 2018.

(51) Int. Cl.

| | |
|---|---|
| ***F41C 23/16*** | (2006.01) |
| ***F41A 3/66*** | (2006.01) |
| ***F41C 27/00*** | (2006.01) |
| *F41C 9/08* | (2006.01) |
| *F41C 7/00* | (2006.01) |

(52) U.S. Cl.

CPC ..... *F41C 23/16* (2013.01); *F41A 3/66* (2013.01); *F41C 27/00* (2013.01); *F41C 7/00* (2013.01); *F41C 9/08* (2013.01)

(58) Field of Classification Search

CPC ..... F41C 23/16; F41A 3/66

USPC ..... 42/71.01, 72, 75.01, 90

See application file for complete search history.

(56) References Cited

U.S. PATENT DOCUMENTS

| | | | | |
|---|---|---|---|---|
| 2,339,331 | A * | 1/1944 | Grigg | F41A 21/485 42/75.01 |
| 2,717,465 | A * | 9/1955 | Clark, Jr. | F41C 23/00 42/75.01 |
| 3,011,283 | A | 12/1961 | Lunn | |
| 3,340,641 | A * | 9/1967 | Recker | F41C 27/22 42/97 |
| 5,711,102 | A * | 1/1998 | Plaster | F41C 23/00 42/71.01 |
| 5,873,189 | A | 2/1999 | Menke | |
| 6,637,142 | B1 * | 10/2003 | Reynolds | F41A 21/485 42/1.06 |
| 6,839,998 | B1 | 1/2005 | Armstrong | |
| 7,428,795 | B2 | 9/2008 | Herring | |

(Continued)

FOREIGN PATENT DOCUMENTS

WO 2016025534 A1 2/2016

OTHER PUBLICATIONS https://geissele.com/super-modular-rail-mk8-m-lokr.html; retrieved Feb. 12, 2020.

*Primary Examiner* — Reginald S Tillman, Jr.

(74) *Attorney, Agent, or Firm* — Carter, Deluca & Farrell LLP

(57) ABSTRACT

A chassis for a firearm includes a lower receiver and a lower forend that are monolithically formed with one another. The lower receiver defines a trigger well that is configured to receive an action. The lower forend extends distally from the lower receiver and defines a channel that is configured to receive a barrel.

20 Claims, 14 Drawing Sheets

(56) References Cited

U.S. PATENT DOCUMENTS

| | | | | |
|---|---|---|---|---|
| 7,926,217 | B2 | 4/2011 | McCann | |
| 8,234,808 | B2 | 8/2012 | Lewis et al. | |
| 9,285,178 | B2 * | 3/2016 | Sellars | F41A 21/485 |
| 9,534,859 | B2 | 1/2017 | Battaglia et al. | |
| 9,726,444 | B1 * | 8/2017 | Sisk | F41A 3/66 |
| 9,766,025 | B1 | 9/2017 | Rood | |
| 9,851,175 | B2 * | 12/2017 | Leasure | F41C 23/16 |
| 10,203,178 | B2 | 2/2019 | Drake | |
| 2006/0272193 | A1 | 12/2006 | Zedrosser | |
| 2007/0180750 | A1 | 8/2007 | Al-Mulla | |
| 2008/0244951 | A1 | 10/2008 | Picard | |
| 2009/0211140 | A1 * | 8/2009 | Rolfe | F41C 23/04 42/71.01 |
| 2010/0162608 | A1 | 7/2010 | McCann | |
| 2011/0283582 | A1 * | 11/2011 | Hunter | F41A 19/10 42/69.02 |
| 2015/0192384 | A1 | 7/2015 | Ballard | |
| 2016/0313087 | A1 | 10/2016 | Leasure | |
| 2017/0219310 | A1 | 8/2017 | Jones | |

* cited by examiner

FIREARM CHASSIS WITH INTEGRATED RAIL SYSTEM

CROSS-REFERENCE TO RELATED APPLICATIONS

This application claims the benefit of, and priority to, U.S. Provisional Patent Application No. 62/739,673, filed Oct. 1, 2018. In addition, this application is a continuation-in-part of U.S. patent application Ser. No. 15/873,468, filed Jul. 17, 2018, which claims the benefit of, and priority to, U.S. Provisional Patent Application No. 62/446,898, filed Jan. 17, 2017. The entire contents of each of the above applications are hereby incorporated by reference.

BACKGROUND

1. Technical Field

The present disclosure relates to firearms and, more specifically, to a tactical firearm system that is monolithically formed from the forearm to the stock mount.

2. Discussion of Related Art

The modern firearm has evolved to utilize a great deal of accessories in response to user demand to address an abundance of unique situations. Modular rifle systems address this demand by allowing manufacturers to produce standard components for a rifle which allows dealers and end users to customize the rifle system. The major components of a modular rifle system are a stock, a chassis, a barrel, and an action. The chassis is the central component of the modular rifle system and may be integrally formed with the stock. The barrel and action each mount to the chassis.

For some situations, precision and accuracy may be required of a modular rifle system. Thus, there is a continuing need for components for modular rifle systems that increase precision and/or accuracy of the completed rifle system.

Modular rifle systems may also include a rail interface system that is secured to the chassis. The rail interface system allows components that require precision, such as optics, to be secured to the chassis. Additionally or alternatively, components that provide stability to the modular rifle system can be secured to the chassis by the rail interface system. Thus, there is a need for rail interface systems that provide increased precision and/or stability to the modular rifle system.

SUMMARY

In an aspect of the present disclosure, a chassis for a firearm includes sidewalls, a forearm, and a first rail portion. The sidewalls define a trigger well and a magazine well therebetween. The sidewalls also define a proximal portion of a channel. The forearm is monolithically formed with the chassis and extends distally from the magazine well. The forearm defines a distal portion of the channel which is configured to receive a barrel of a firearm. The first rail portion extends from the forearm adjacent the channel on a first side of the chassis. The first rail portion defines part of a rail system that is configured to securely mount an accessory directly to the chassis. The first rail portion may be monolithically formed with the forearm.

In aspect, the forearm includes a second rail portion that extends from the forearm adjacent the channel on a second side of the chassis that is opposite the first side of the chassis such that the channel passes between the first and second rail portions. The first and second rail portions may extend from the forearm such that an upper surface of each of the first and second rail portions is configured to extend above a centerline of a barrel received within the channel. The sidewalls may have an upper surface that is configured to be positioned below a centerline of a barrel received within the channel. The forearm may include a lower surface that defines a lower rail system that is configured to securely mount an accessory directly to the chassis.

In some aspects, the chassis includes a proximal portion that extends proximally from the trigger well. The proximal portion may be configured to receive a stock. The proximal portion may include a fastener that is configured to secure a grip to a lower surface thereof. The proximal portion may be integrally formed with the stock. The stock may be a fixed stock, a folding stock, and/or an adjustable stock.

In another aspect of the present disclosure, a grip for a firearm includes a distal strut, a connector, and a hand grip. The distal strut is configured and dimensioned to flushingly receive a trigger guard of a firearm. The connector extends proximally from the distal strut and is configured to releasably secure to a proximal portion of a chassis. The hand grip extends proximally from the connector. The hand grip has an upper surface that is configured to be spaced apart from and oppose the proximal portion of the chassis and a stock. The hand grip has a lower surface that extends from the connector. A plane defined by the lower surface forms an acute angle with a plane defined by the upper surface. The lower surface is configured to receive non-trigger fingers of a hand.

In aspects, the connector includes a connecting surface having an opening that is configured to receive a fastener therethrough to secure the grip to the chassis.

In another aspect of the present disclosure, a method includes securing a barrel in a channel that is defined by a chassis and securing a first accessory to a first rail system of the chassis. The chassis includes sidewalls that define a proximal portion of the channel and a forearm that defines a distal portion of the channel. The first rail system extends from the forearm on a first side of the channel such that an upper surface of the first rail system is positioned above a centerline of the barrel when the barrel is received within the channel. The first rail system being monolithically formed with the forearm.

In aspects, securing the first accessory includes securing the first accessory to a second rail system of the chassis. The second rail system may extend from the forearm on a second side of the channel such that an upper surface of the second rail system is positioned above the centerline of the barrel when the barrel is received within the channel and the barrel is positioned between the first and second rail portions. The second rail system may be monolithically formed with the forearm.

In some aspects, the method includes securing a second accessory to a lower rail system of the chassis. The lower rail system may be defined in a lower surface of the forearm opposite of the channel.

In certain aspects, the method includes positioning a trigger mechanism in a trigger well defined by the sidewalls and securing a ridgeline grip to a proximal portion of the chassis proximal of the trigger well such that a distal strut of the ridgeline grip receives a portion of a trigger guard of the trigger mechanism. The trigger mechanism also has a trigger which may be partially surrounded by the trigger guard. The ridgeline grip may have a connector that extends proximally from the distal strut and a hand grip that extends proximally from the connector. The hand grip has an upper surface that is spaced apart from and opposed to a proximal portion of the chassis and a lower surface that extends from the connector. The plane is defined by the lower surface that forms an acute angle with a plane defined by the upper surface. The lower surface is configured to receive non-trigger fingers of a hand.

In particular aspects, securing the ridgeline grip includes passing a fastener through the connector of the ridgeline grip and into the proximal portion of the chassis. The method may include securing a stock to the proximal portion of the chassis such that the upper surface of the hand grip opposes a portion of the stock.

In another aspect of the present disclosure, a chassis for a firearm includes a lower receiver and a lower forend that are monolithically formed with one another. The lower receiver defines a trigger well that is configured to receive an action. The lower forend extends distally from the lower receiver and defines a channel that is configured to receive a barrel.

In aspects, the chassis includes a lower rail that is secured to a lower surface of the lower forend. The lower surface may be opposite the channel. The lower rail may be monolithically formed with the lower forend. The lower rail may extend longitudinally along the lower surface of the lower forend and is configured to secure an accessory to the lower forend in a plurality of longitudinal positions.

In some aspects, the chassis includes an upper forend secured to the lower forend. A portion of the channel may be defined between the upper and lower forends. The chassis may include an upper rail disposed on an upper surface of the upper forend opposite the channel. The upper rail may be monolithically formed with the upper forend. The upper forend may be monolithically formed with the lower forend.

In certain aspects, the chassis includes a stock mount that is secured to the lower receiver. The stock mount may be configured to secure a stock to the lower receiver. The stock mount may be monolithically formed with the lower receiver.

In particular aspects, the chassis includes an upper carriage that is secured to the lower receiver. The upper carriage may be monolithically formed with the upper forend.

In aspects, the lower receiver defines a magazine well that is configured to receive a magazine containing one or more cartridges suitable for the action. The lower forend may extend distally from the magazine well.

In another aspect of the present disclosure, a firearm includes a lower chassis, an action, and a barrel. The lower chassis includes a lower receiver and a lower forend that is monolithically formed with the lower receiver. The lower receiver includes a trigger well. The lower forend extends distally from the lower receiver and defines a channel. The action is received within the trigger well and the barrel is received within the channel.

In aspects, the firearm includes a lower rail monolithically formed on a lower surface of the lower forend with the lower surface being opposite the channel. The fire arm may include an upper forend that is secured to the lower forend with a portion of the channel defined between the upper and lower forends.

In some aspects, the firearm includes a stock that is secured to and extends proximally from the lower chassis. The firearm may include an upper carriage that is secured to the lower receiver.

In another aspect of the present disclosure, a firearm includes a lower chassis, an upper forend, an upper carriage, a stock, an action, and a barrel. The lower receiver defines a trigger well and a magazine well. The lower forend extends distally from and is monolithically formed with the lower receiver. The upper forend is secured to the lower forend with a channel being defined between the upper and lower forends. The upper carriage is secured to the lower receiver of the trigger well to define a chamber. The stock is secured to and extends proximally from the lower receiver. The action is received within the trigger well. The barrel is received within the channel.

Further, to the extent consistent, any of the aspects described herein may be used in conjunction with any or all of the other aspects described herein.

BRIEF DESCRIPTION OF THE DRAWINGS

Various aspects of the present disclosure are described hereinbelow with reference to the drawings, which are incorporated in and constitute a part of this specification, wherein.

DETAILED DESCRIPTION

Figure 1:
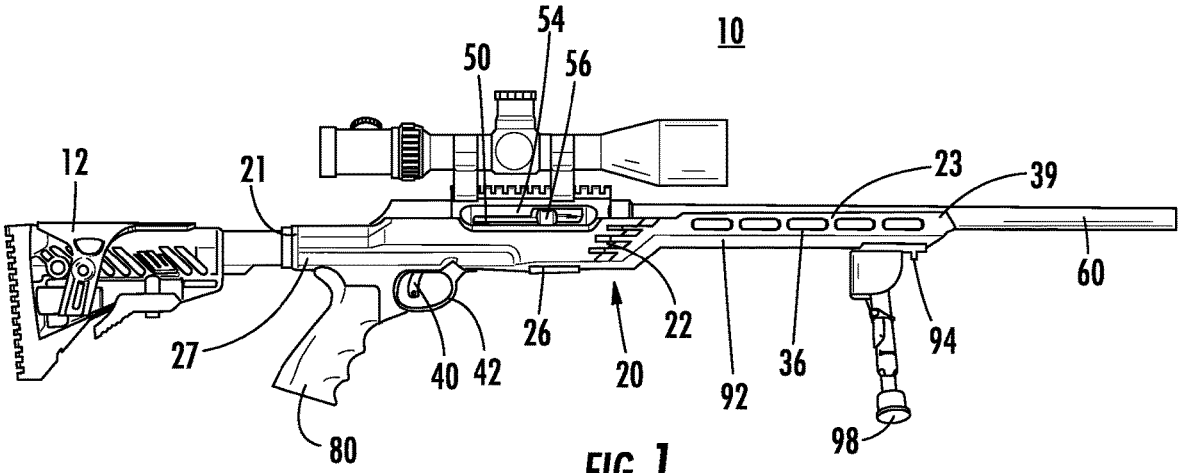
FIG. 1 is a right side view of a firearm provided in accordance with the present disclosure including a barrel, an action, and a tactical chassis system having an integrated rail system.

Embodiments of the present disclosure are now described in detail with reference to the drawings in which like reference numerals designate identical or corresponding elements in each of the several views. Throughout this description, the term "proximal" refers to the portion of the device or component thereof that is closer to a butt of the firearm and the term "distal" refers to the portion of the device or component thereof that is closer to a muzzle or end of a barrel of the firearm.

A modular rifle system including a tactical chassis is described herein. The tactical chassis may include an integrated rail system. The integrated rail system may include a rail interface on the right, left, lower, and/or top surface of the chassis. The tactical chassis may be used with a variety of grips including a pistol grip or a ridgeline grip. The modular rifle system may include a semi-automatic action.

Figure 2:
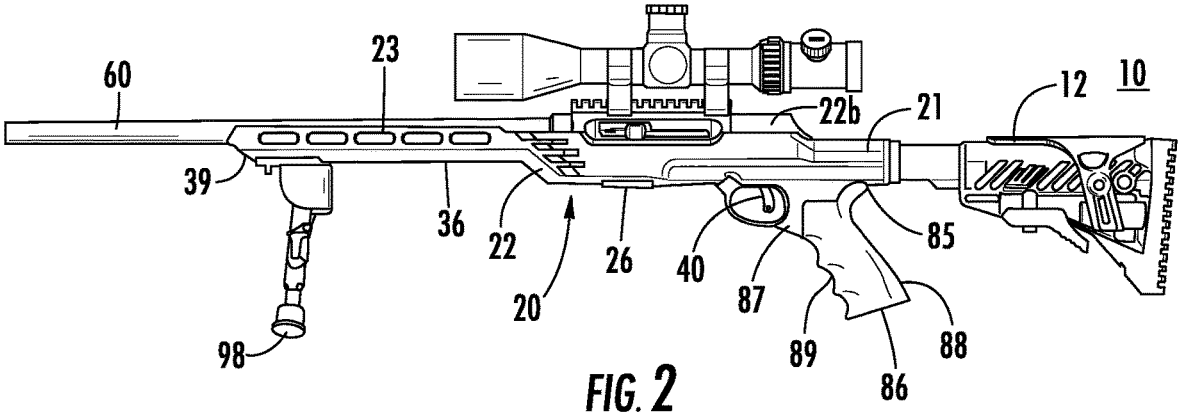
FIG. 2 is a left side view of the firearm in FIG. 1.
Figure 3:
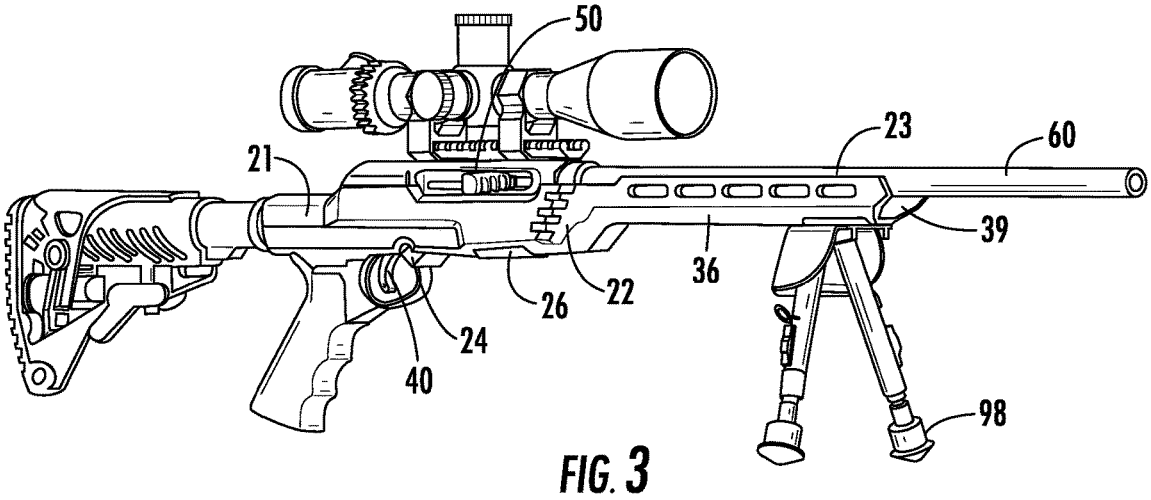
FIG. 3 is a perspective view of the firearm in FIG. 1.

Referring to FIGS. 1-3, a modular rifle system 10 is provided in accordance with the present disclosure and includes a stock 12, a tactical chassis 20, a trigger mechanism 40, an action 50, a barrel 60, and a magazine (not explicitly shown). As shown, the action 50 is a .17 HMR semi-automatic action; however, the action 50 may be a variety of actions including, but not limited to, a .17 HRM action, a .22 LR action, a .22 Magnum action, a .308 action, a .410 action, a rimfire action, a short or long bolt action, a short or long semi-automatic action, a short or long action shotgun action, or a muzzle loader action.

The tactical chassis 20 includes sidewalls 22 that extend from a proximal portion 21 to a distal portion 39. The tactical chassis 20 defines a trigger well 24 (FIGS. 4 and 5) and a magazine well 26 and includes a forearm 36 that extends from the magazine well 26 to the distal portion 39 of the tactical chassis 20. The trigger well 24 receives the trigger mechanism 40 and the magazine well 26 receives a magazine. The magazine may be releasably secured within the magazine well or may be an internal magazine received within the forearm 36 of the tactical chassis 20.

The stock 12 is secured to the proximal portion 21 of the tactical chassis 20. The stock 12 may be integrally formed with or releasably secured to the proximal portion 21 of the tactical chassis 20. As shown, the stock 12 is an adjustable stock; however, the stock 12 may be a fixed stock, a folding stock, or an adjustable folding stock.

Figure 4:
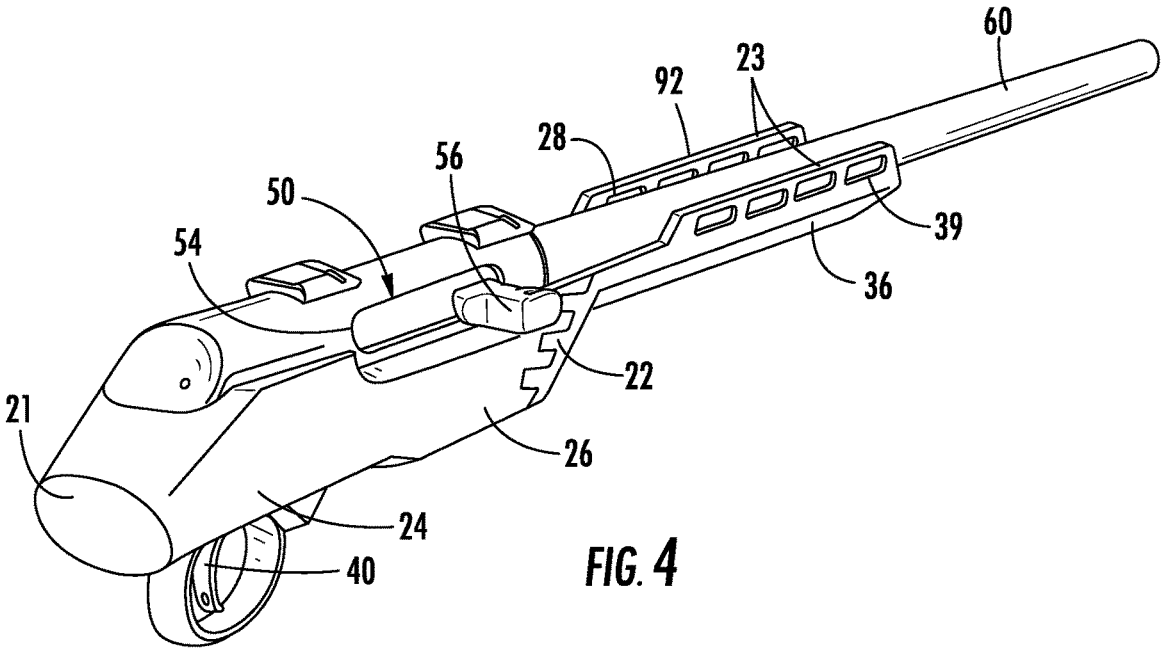
FIG. 4 is an upper back, side perspective view of a portion of the firearm of FIG. 1 illustrating the tactical chassis system, barrel, and action.

Referring now to FIG. 4, the sidewalls 22 of the tactical chassis 20 defines a proximal portion of a channel 28 above the trigger well 24 and the magazine well 26. The channel 28 receives the action 50 and the barrel 60. The proximal portion of the channel 28 cradles about 135° of the action 50 and the barrel 60 such that upper surfaces of the sidewalls 22 are positioned below a centerline of the action 50 and the barrel 60 adjacent the action 50 and the barrel 60.

Figure 5:
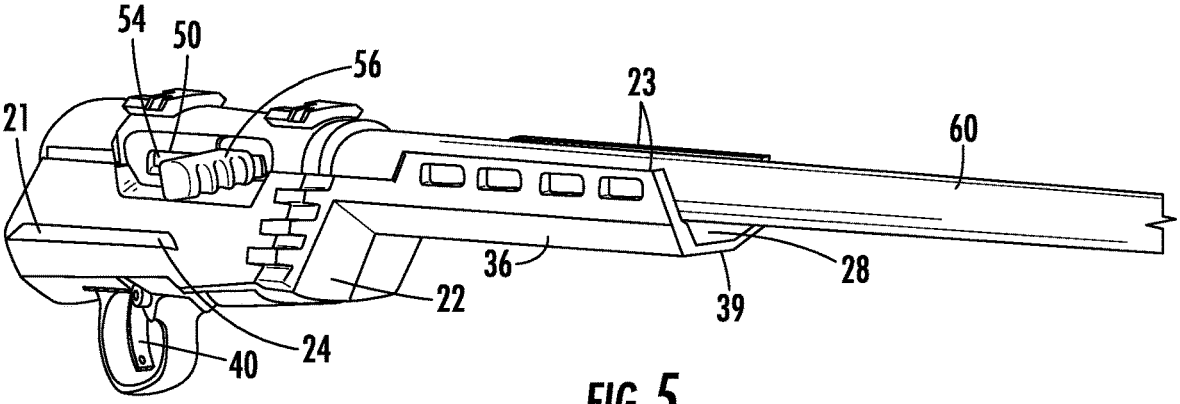
FIG. 5 is a front, side perspective view of the portion of the firearm of FIG. 4.
Figure 6:
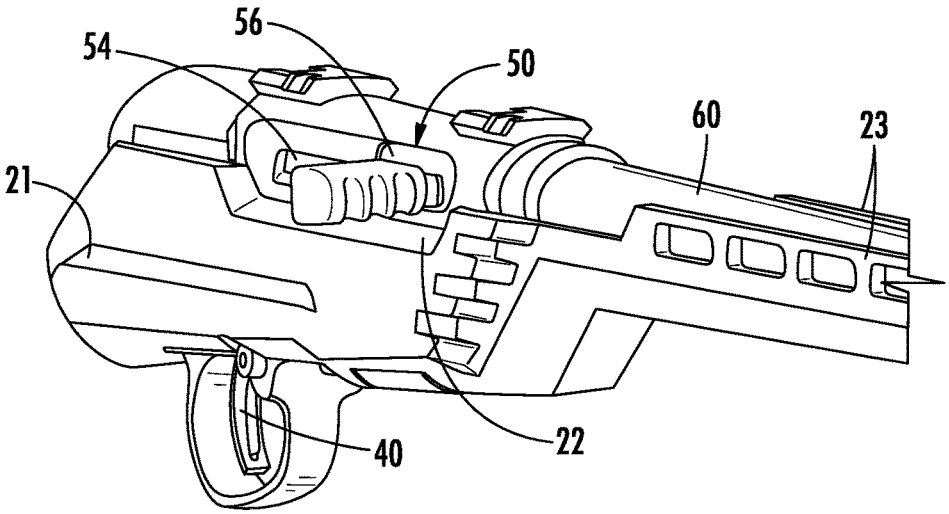
FIG. 6 is an enlarged front, side perspective view of the portion of the firearm of FIG. 4.
Figure 7:
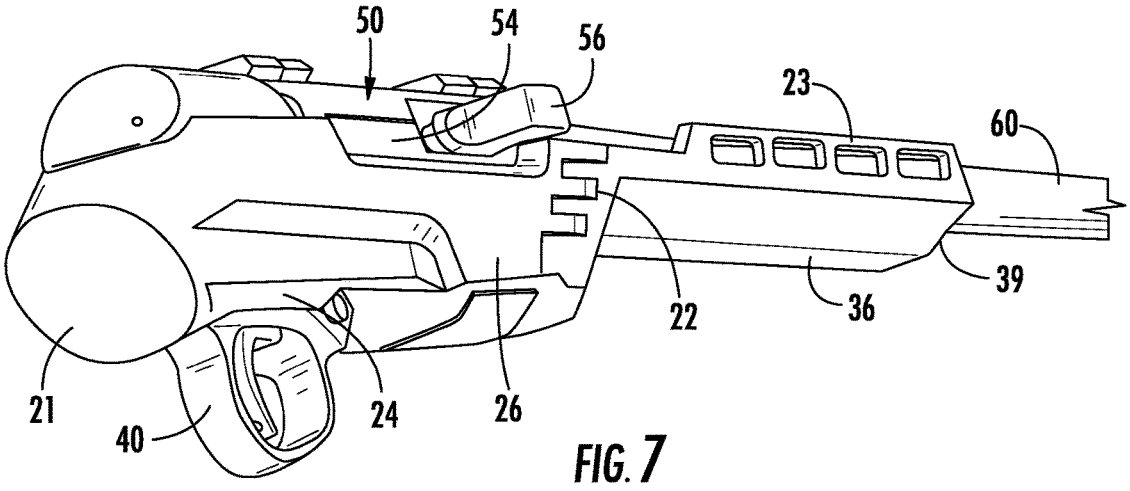
FIG. 7 is a lower back,-side perspective view of the portion of the firearm of FIG. 4.

With reference to FIGS. 4-6, the action 50 includes a slide 54 and defines a chamber 52 (FIG. 6). The slide 54 is slidable within the action 50 between a first configuration (FIG. 6) in which the slide 54 is in an open position to provide access to the chamber 52 and a second configuration (FIG. 4) in which the slide 54 is locked in a closed position such that the chamber 52 of the action 50 is closed. In the closed position, the chamber 52 is closed and the trigger mechanism 40 is actuatable to fire a cartridge (not shown) positioned within the chamber 52. The slide 54 includes a slide arm 56 that extends from and is secured to the slide 54. The slide arm 56 is engagable by an end user to manually move the slide 54 between the closed position and the open position. The slide 54 may be biased towards the closed position. It will be appreciated that when the action 50 is a semi-automatic action, the action 50 will transition the slide 54 from the second configuration to the first configuration upon firing of the cartridge and the bias of the slide 54 will return the slide 54 to the second configuration such that the action 50 is prepared to fire a fresh cartridge loaded into the chamber 52.

Referring now to FIGS. 1-7, the tactical chassis 20 is configured to receive a right-handed action 50; however, it is contemplated that the chassis 20 may receive a left-handed or ambidextrous action. As shown, the action 50 is a right-handed action 50 allowing the chamber 52, the slide 54, and the slide arm 56 to be accessed from the right side of the modular rifle system 10. In the closed position, the slide arm 56 is positioned at a distal end of a slide rail 58 within the action 50 as shown in FIG. 6. To move the slide 54 to the open position, the slide arm 56 is slid proximally along the slide rail 58. When the slide arm 56 reaches a proximal end of the slide rail 58, the action 50 is in a fully open position. As the slide 54 slides to the fully open position, a cartridge (not shown) may be ejected from the chamber 52. In the right-handed configuration, the cartridge is ejected from the right side of the chamber 52. As the slide 54 reaches the fully open position, a lower portion of the chamber 54 is opened to allow a new cartridge from the magazine (not shown) to enter the chamber 52. Alternatively, a new cartridge may be placed directly into the chamber 52 when the slide 54 is in the open position.

When a new cartridge is within the chamber 52, the slide arm 56 is engaged to slide the slide 54 distally towards the closed position. As the slide 54 slides distally along the slide rail 58, the new cartridge is positioned or loaded into the chamber 52. When the slide 54 reaches the closed position, the slide arm 56 is located at the distal end of the slide rail 58. The slide 54 may be biased towards the closed position such that the slide 54 automatically slides distally to load the new cartridge and to close the chamber 52.

Referring now to FIG. 5, the forearm 36 includes rail portions 23 that extend from the forearm 36 such that each of the rail portions 23 extends above the centerline of the barrel 60. Each of the rail portions 23 defines a rail interface system 92 (FIG. 1) that is monolithically formed with the tactical chassis 20 such that the tactical chassis 20 is configured to receive accessories as detailed below. Additionally or alternatively, a lower surface of the forearm 36 may define a lower rail interface system 94 configured to receive accessories. For example, the lower rail interface system 94 may receive a bipod 98 (FIG. 1). In addition, the lower rail interface system 94 may receive a foregrip (not shown)

As shown, the rail interface system 92 and the lower rail interface system 94 are M-LOK® rail systems, which is a rail system that is commonly known in the art and is shaped to receive M-LOK® accessories. It is also contemplated that other rail systems that are commonly known in the art may be monolithically formed in the rail portions 23 and lower portion of the forearm 36 of the tactical chassis 20 including, but not limited to, a Picitinny rail system, a KeyMod rail system, or other rail systems as will be familiar to the skilled practitioner.

Referring back to FIGS. 1-3, the modular rifle system 10 includes a pistol grip 80 that protrudes conspicuously below the action 50 of the rifle 10 to allow for a pistol style grasp in which the web of the trigger hand (between the thumb and index finger) can be placed below the top exposed portion of the trigger mechanism 40 while firing. The pistol grip 80 includes an upper portion 84 that forms an elliptical shape such that the web of the firing hand can rest comfortably below the top exposed portion of the trigger mechanism 40 and a lower portion 86 that extends proximally and downward to form an acute angle with respect to the proximal portion 21 of the tactical chassis 20. It is contemplated that the upper portion 84 of the pistol grip 80 may form different shapes to receive the web of the firing hand and that the lower portion 86 of the pistol grip 80 may protrude from the chassis 20 at any angle to allow for a pistol style grasp.

The pistol grip 80 has a proximal side 88 that is contoured to receive a palm of a firing hand. It is contemplated that the contour of the proximal side 88 may take on any shape to comfortably receive the palm of the user's hand. The pistol grip 80 has a distal side 89 that contains ridges to receive non-trigger fingers of a firing hand of an end user. It is contemplated that the ridges may take on any shape or depth to comfortably receive the non-trigger fingers. It is also contemplated that the distal side 89 of the pistol grip 80 may be smooth. The distal side 89 may include an upper end portion 87 that is contoured to sit flush with a radius of a trigger guard 42 of the trigger mechanism 40. The pistol grip 80 is secured to the tactical chassis 20 by a fastener 82 (FIG. 9) that passes through the upper end portion 87.

Figure 8:
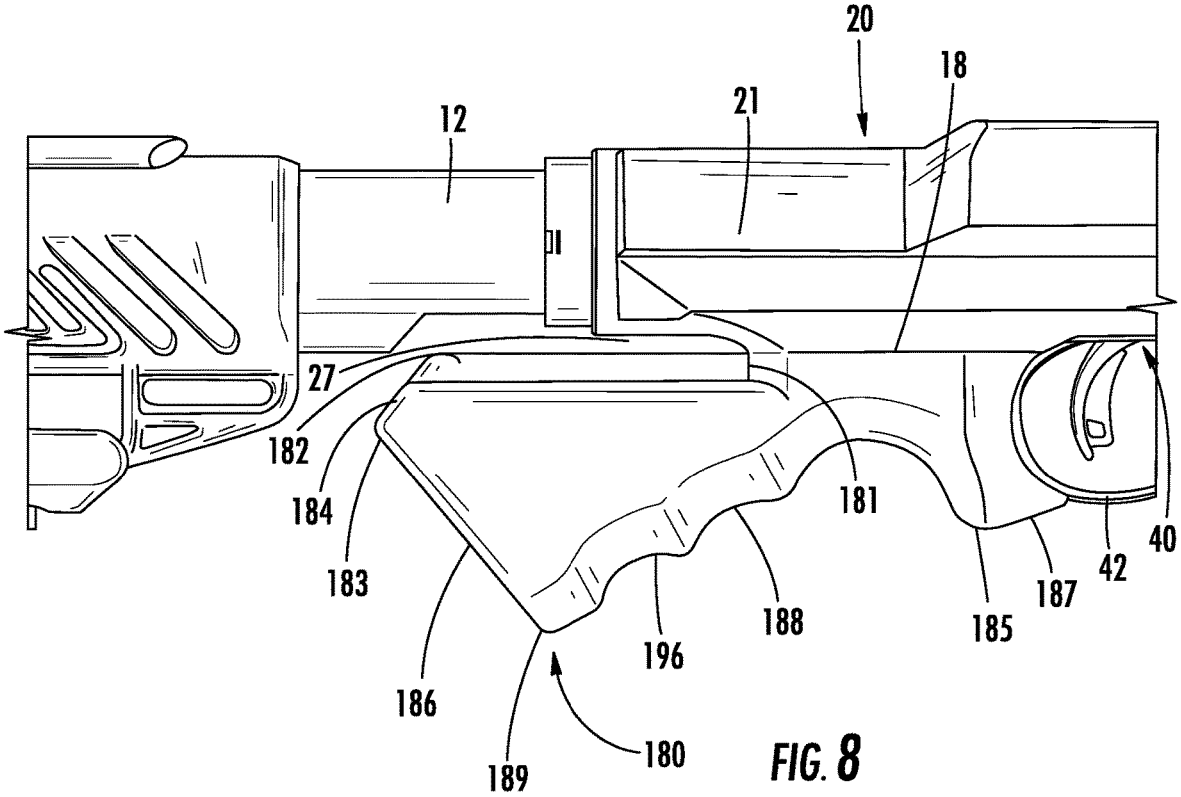
FIG. 8 is a side view of a portion of the firearm of FIG. 1 with a ridgeline grip provided in accordance with the present disclosure.
Figure 9:
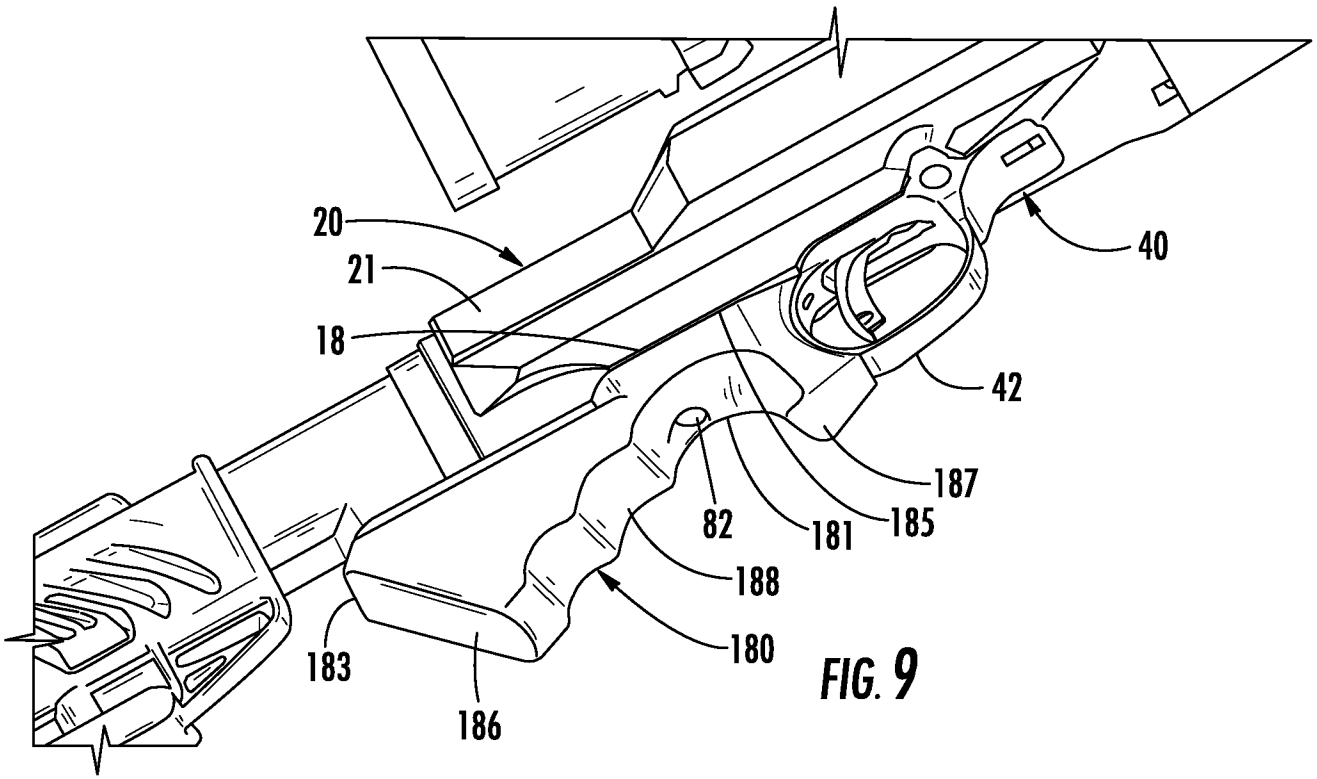
FIG. 9 is a lower perspective view of the portion of the firearm of FIG. 8.

Referring now to FIGS. 8 and 9, a ridgeline grip 180 is provided in accordance with the present disclosure. The ridgeline grip 180 is secured to a lower surface 18 of the proximal portion 21 of the tactical chassis 20 by a fastener 82 (FIG. 9). The ridgeline grip 180 includes a connecting surface 185 that is secured to the tactical chassis 20 with the fastener 82 such that the connecting surface 185 of the ridgeline grip 180 is flush with the lower surface 18 of the tactical chassis 20. When the ridgeline grip 180 is secured to the tactical chassis 20, the ridgeline grip 180 extends from the trigger guard 42 of the trigger mechanism 40 to a proximal well 27 of the proximal portion 21 of the tactical chassis 20.

The connecting surface 185 of the ridgeline grip 180 forms a corner with a proximal well wall 181 that descends a short distance to an exposed upper surface 182 of the ridgeline grip 180. The upper surface 182 of the ridgeline grip 180 extends proximally from the proximal well wall 181 beyond a proximal end of the proximal portion 21 of the tactical chassis 20 such that a portion of the upper surface 182 opposes the stock 12. As shown, a proximal tip 183 of the ridgeline grip 180 forms an angled surface 184 between the exposed upper surface 182 and a back edge 186 of the ridgeline grip 180. The backside wall 186 extends from the angled surface 184 to a lower tip 189 of the ridgeline grip 180. The angled surface 184 and the back edge 186 of the ridgeline grip 180 may meet at a variety of angles. The angled surface 184 may be a smooth curve or a plurality of surfaces to form polygonal shape when viewed from the side between the exposed upper surface 182 and the back edge 186.

The ridged face 188 of the ridgeline grip 180 extends from the lower tip 189 to a distal strut 187 of the ridgeline grip 180. The ridged face 188 of the ridgeline grip includes distinct ridges 190 to receive non-trigger fingers of a firing hand. As shown, the ridges 190 are radial in shape; however, it is contemplated that the ridges 190 may take on any shape or depth to comfortably receive non-trigger fingers. The distal strut 187 of the ridgeline grip 180 is contoured to sit flush with the trigger guard 42 of the trigger mechanism 40 such that the distal strut 187 flushingly receives the trigger guard 42.

The ridgeline grip 180 protrudes slightly below the trigger guard 42 of the modular rifle system 10 to allow for a rifle style grasp in which the web of the trigger hand can be placed above, or at the same level as, the top exposed portion of the trigger mechanism 40 during firing. The ridgeline grip 180 extends below the action to a lesser extent than the pistol grip 80 (FIG. 1) and does not allow for a pistol style grasp.

With particular reference to FIG. 9, the ridgeline grip 180 is secured to the tactical chassis 20 by the fastener 82. The fastener 82 passes through the distal strut 187 of the ridgeline grip 180 to secure the ridgeline grip 180 to the proximal portion 21 of the tactical chassis 20.

It is contemplated that a tactical chassis (e.g., tactical chassis 20) and grip (e.g., pistol grip 80 or ridgeline grip 180) may be constructed from the same material or made from different materials. Contemplated materials for the chassis and grips include, but are not limited to, natural materials (e.g. wood), man-made materials (e.g., Kevlar), composite materials (e.g., carbon fiber), metals, metal alloys, synthetic materials, laminated materials, compressed woven materials, and any combination thereof.

Figure 10:
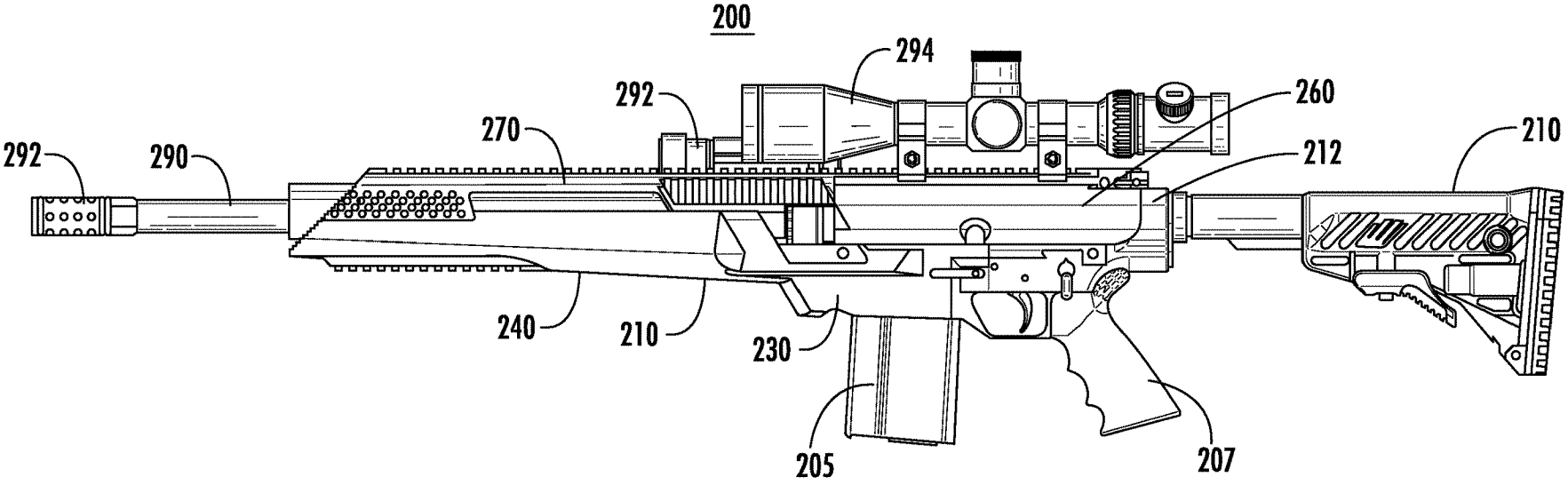
FIG. 10 is a side view of another firearm provided in accordance with the present disclosure.
Figure 11:
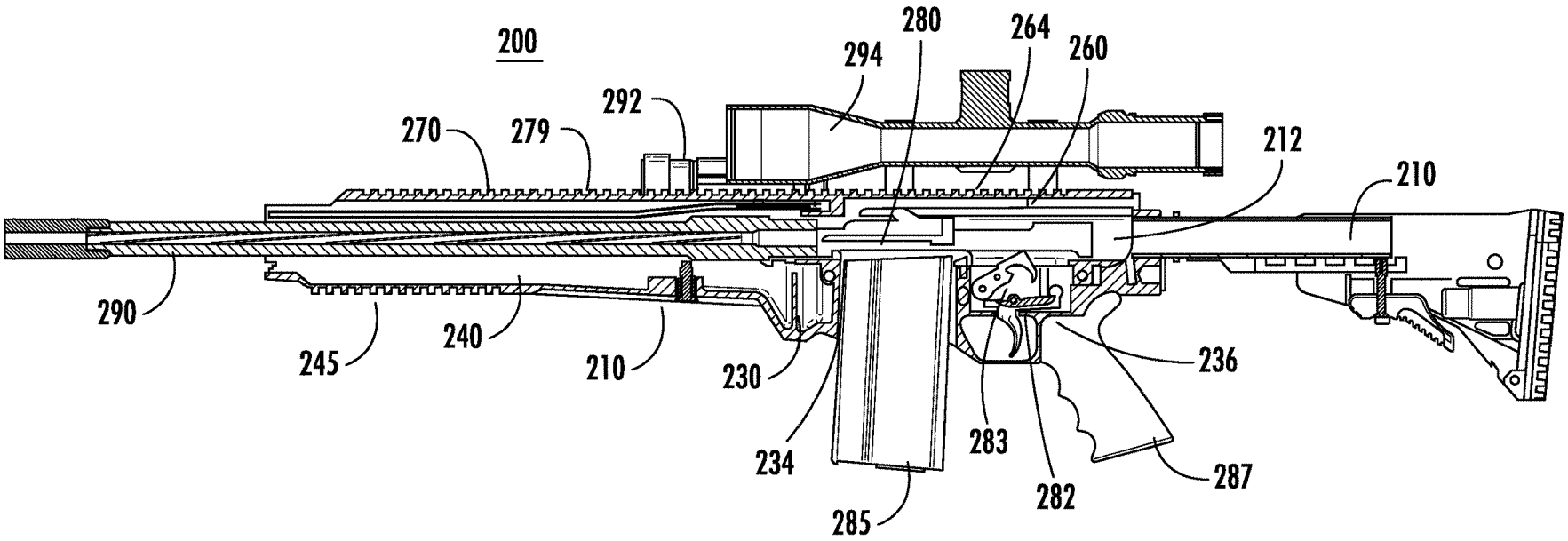
FIG. 11 is a side cross-sectional view of the firearm of FIG. 10.
Figure 12:
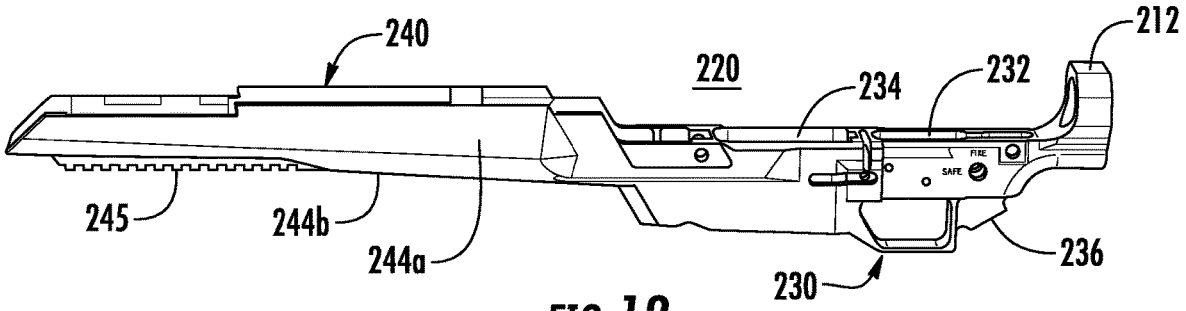
FIG. 12 is a side view of a lower chassis of the firearm of FIG. 10.
Figure 13:
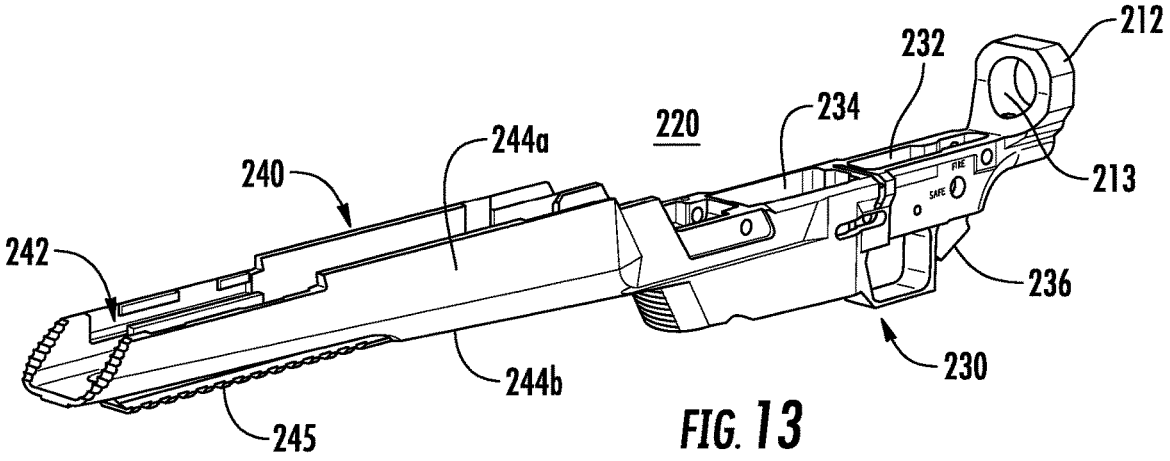
FIG. 13 is a perspective view of the lower chassis of FIG. 12.
Figure 14:
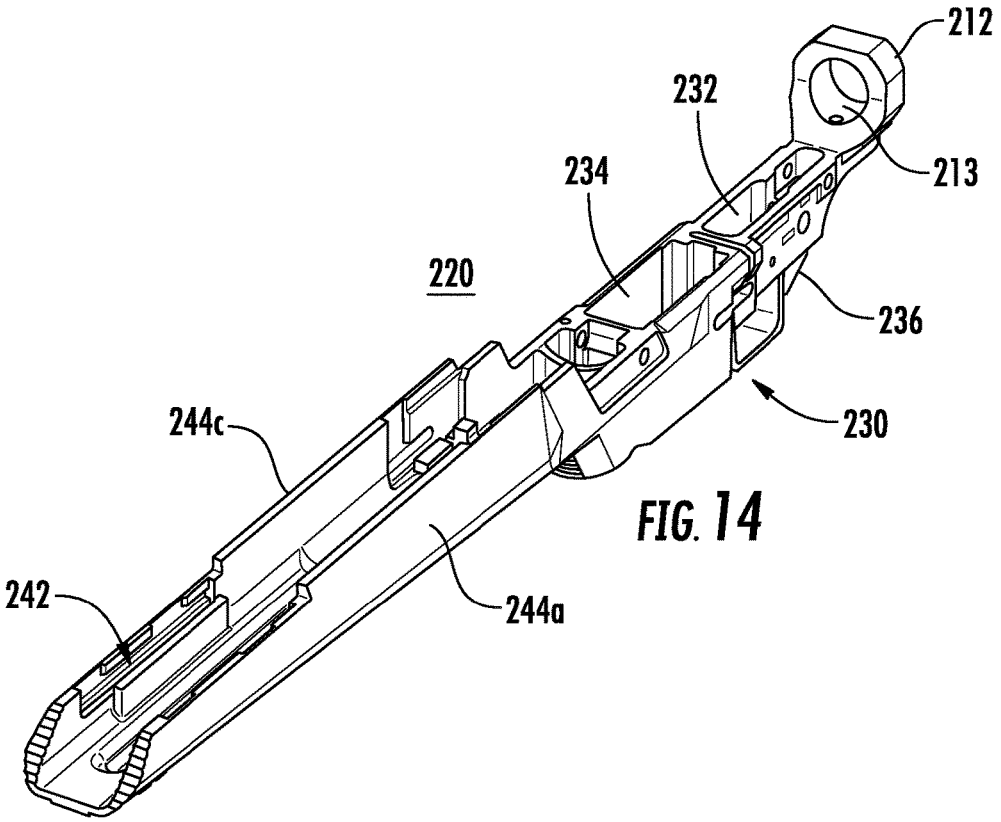
FIG. 14 is a top perspective view of the lower chassis of FIG. 12.
Figure 15:
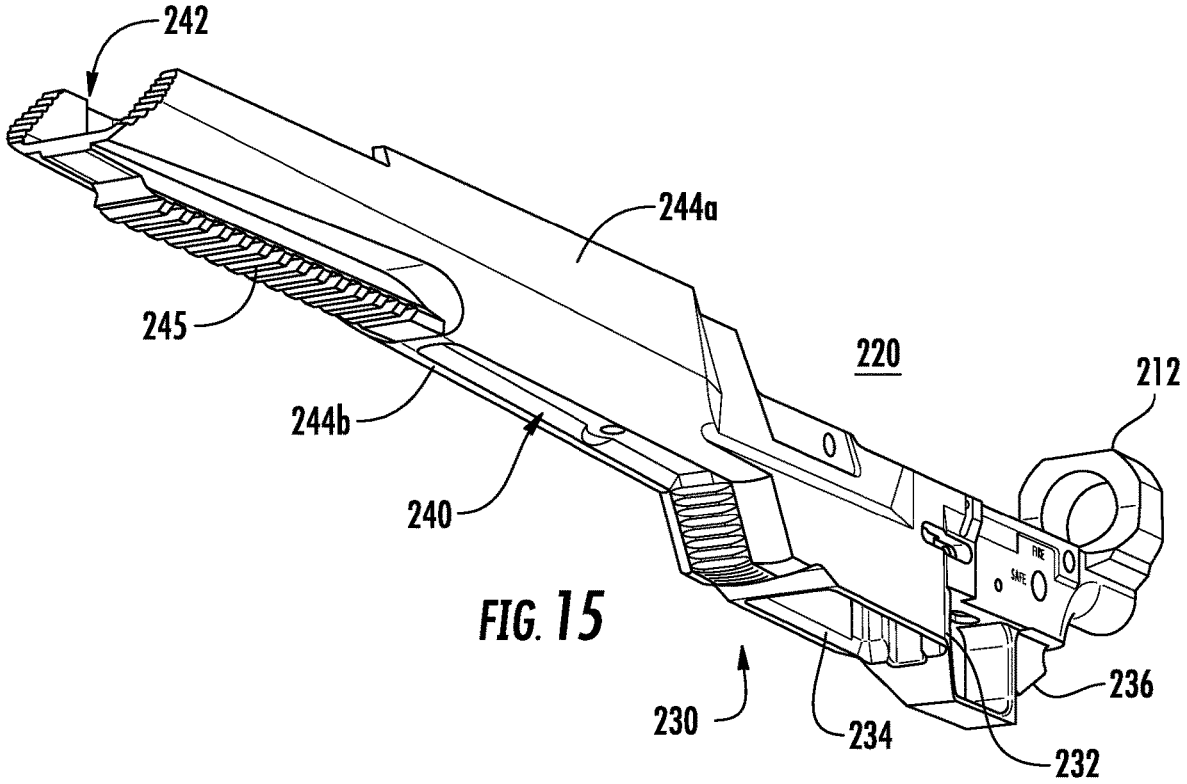
FIG. 15 is a bottom perspective view of the lower chassis of FIG. 12.

With reference to FIGS. 10 and 11, another firearm 200 is provided in accordance with the present disclosure which includes a stock 210, a lower chassis 220, an upper carrier 260, an upper forend 270, an action 283, a magazine 285, a grip 287, a barrel 290, and a break 292 secured to the barrel 290.

Referring to FIGS. 12-16, the lower chassis 220 includes, from a proximal end to a distal end, a stock mount 212, a lower receiver 230, and a lower forend 240. The entire lower chassis 220 is monolithically formed which may form a stable platform for components of a rifle system. Forming a stable platform may improve the accuracy and/or precision of a firearm, e.g., firearm 200 (FIG. 10), built on the lower chassis 220. In addition, by having the lower receiver 230 monolithically formed in the lower chassis 220, the lower chassis 220 may be considered a registered firearm.

The stock mount 212 defines a distal portion of the lower chassis 220 and is substantially circular in shape. The stock mount 212 is configured to secure a stock, e.g., stock 210 (FIG. 10), to the lower chassis 220. An inner surface 213 of the stock mount 212 may be threaded such that a stock may be threaded into the stock mount 212. In some embodiments, a bugger tube (not shown) passes through the stock mount 212. In some embodiments, the stock mount 212 is separate from the lower chassis 220 and is secured to the lower chassis 220 by one or more fasteners or a fastening system (not shown). In certain embodiments, the stock mount 212 is monolithically formed, integrally formed, or secured to the upper carrier 260 (FIG. 10).

Figure 16:
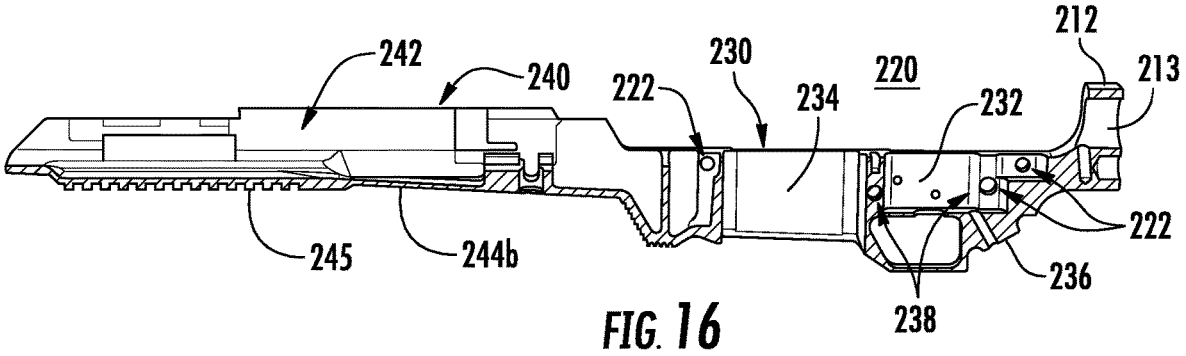
FIG. 16 is a side cross-sectional view of the lower chassis of FIG. 12.

With particular reference to FIG. 16, the lower receiver 230 includes a trigger well 232, a magazine well 234, and a grip mount 236. The trigger well 232 is configured to at least partially receive an action, e.g., action 283 (FIG. 11). The action 283 may be any suitable action. For example, the action 283 may be rimfire or center fire, may be semi-automatic or fully automatic, and may be a variety of calibers, e.g., .17, .17-223, .20, .204, .220, .222, .223, .22, .224, .243, .25, .270, .277, .30, .300, .30-06, .308, .338, .358, .375, .45, .500, 5.45, 5.56, 6 mm, 6.5 mm, 7 mm, 20 Gauge, 12 Gauge, .410, etc. In some embodiments, the lower receiver 230 is an AR-15, AR-10, or a clone equivalent or modified clone equivalent thereof.

The magazine well 234 is configured to receive a magazine, e.g., magazine 285 (FIG. 11), that may be fixed to or removable from the lower receiver 230 and configured to hold one or more cartridges of suitable ammunition for the action 283 received in the trigger well 232. As shown, the magazine well 234 is positioned distal of the trigger well 232; however, the magazine well 234 may be positioned proximal of the trigger well 232. The magazine well 44 is configured to feed cartridges into a chamber as detailed below.

The grip mount 236 is configured to secure a grip, e.g., grip 287 (FIG. 11) to the lower receiver 230. The grip may be any suitable grip, e.g., a pistol grip or a ridgeline grip. In some embodiments, no grip is secured to the grip mount 236.

The lower receiver 230 may also include openings 238 that are configured to receive fasteners to secure components, e.g., a magazine, an action, or a grip, to the lower receiver 230. The lower chassis 220 may also include openings 222 that are configured to receive fasteners to secure the upper carrier 260 and/or the upper forend 270 to the lower chassis 220.

The lower forend 240 of the lower chassis 220 is substantially U-shaped in lateral cross-section to define a channel 242 therein. The channel 242 is configured to receive a barrel, e.g., barrel 290 (FIG. 11). The lower forend 240 has one or more flat surfaces 244*a*, 244*b*, 244*c* (FIGS. 14 and 15) that may include mounting systems such as rails integrally formed thereon. For example, the lower surface 244*b* of the lower forend 240 includes a lower rail 245 that is configured to mount one more accessories, e.g., a strap, bipod, tripod, light, laser sight, etc., to the lower chassis 220. The lower rail 245 extends longitudinally along the lower surface 244*b* such that the one or more accessories to be mounted in a plurality positions longitudinally spaced apart from one another along the lower rail 245. In some embodiments, the lower rail 245 is monolithically formed in the lower surface 244*b* of the lower forend 240. Alternately, the lower rail 245 may be secured to the lower surface 244*b* by one or more fasteners.

The lower forend 240 extends distally from the magazine well 234. As shown, the lower forend 240 is monolithically formed with the lower receiver 230. In some embodiments, the lower forend 240 may be formed of one or more components. For example, the lower forend 240 may have a proximal portion that is monolithically formed with the lower receiver 230 and extends distally from the magazine well 234 and is then secured to a distal portion of the lower forend 240 by one or more fasteners. The proximal portion of the lower forend 240 may extend distally in a range of about 0.5 inches to about 28 inches from the magazine well 234. Extending the lower forend 240 has shown to increase the precision and accuracy of firearms based on a chassis with a monolithically formed lower forend 240.

Figure 17:
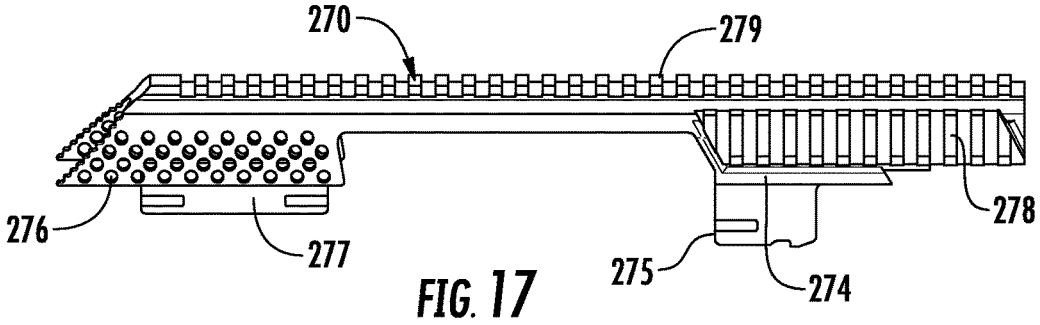
FIG. 17 is a side view of an upper forend of the firearm of FIG. 10.
Figure 18:
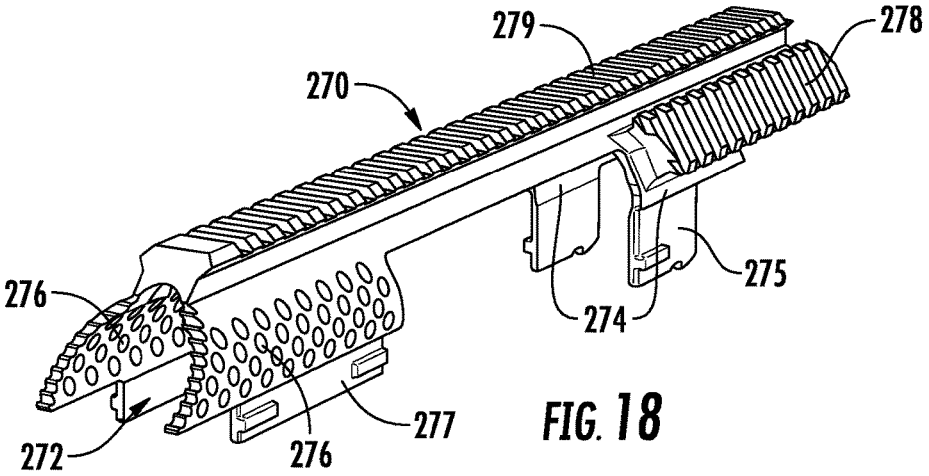
FIG. 18 is a perspective view of the upper forend of FIG. 17.
Figure 19:
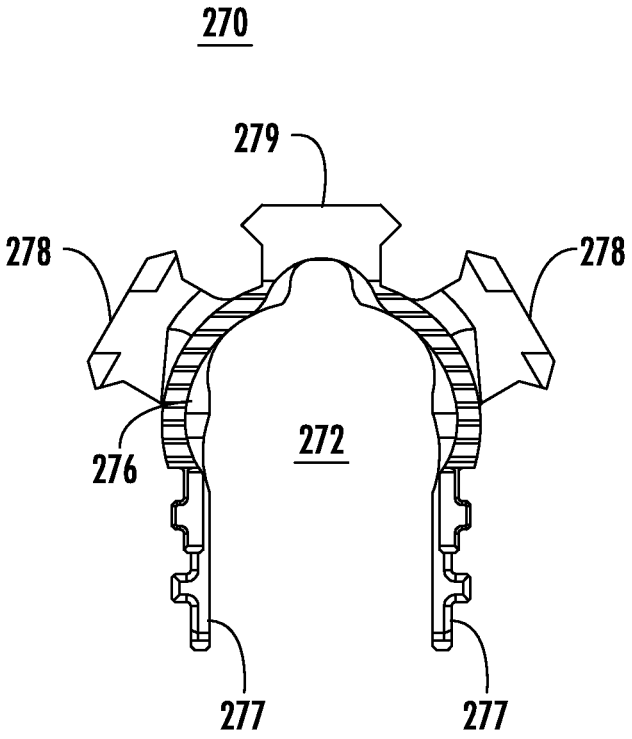
FIG. 19 is a front view of the upper forend of FIG. 17.
Figure 20:
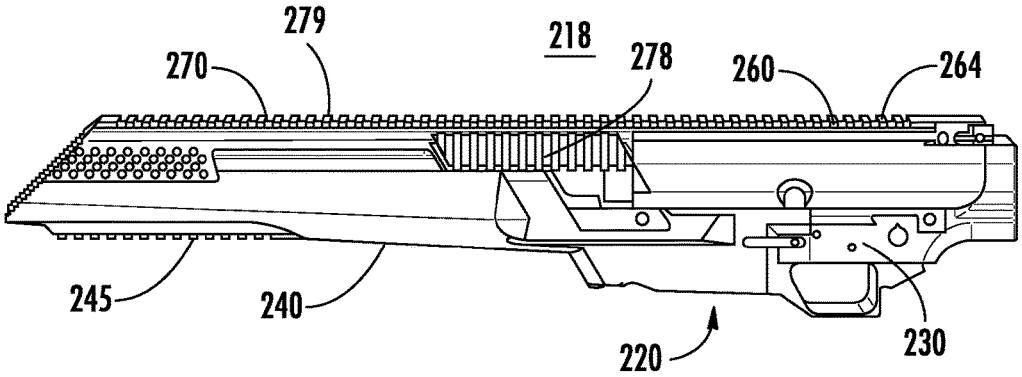
FIG. 20 is a side view of a body of the firearm of FIG. 10 including the lower chassis, the upper forend, and an upper carrier.
Figure 21:
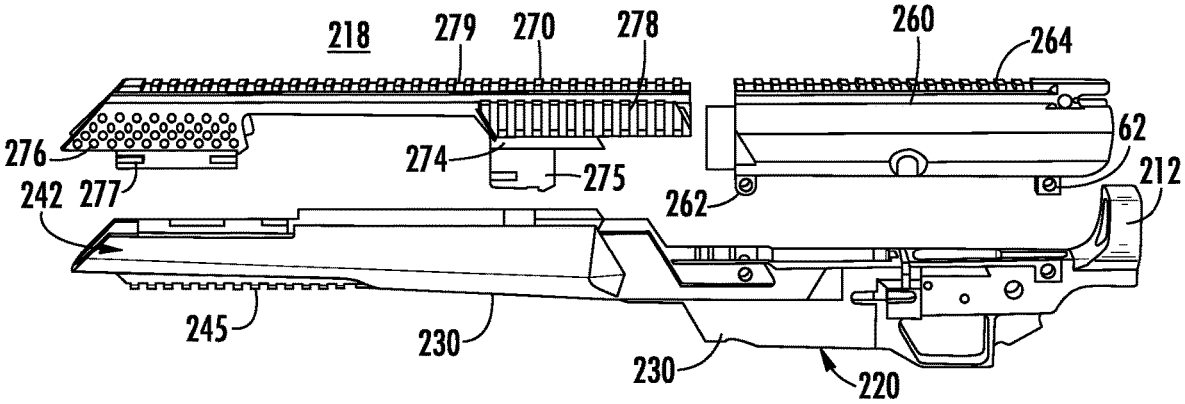
FIG. 21 is a side view, with parts separated, of the body of FIG. 20.
Figure 22:
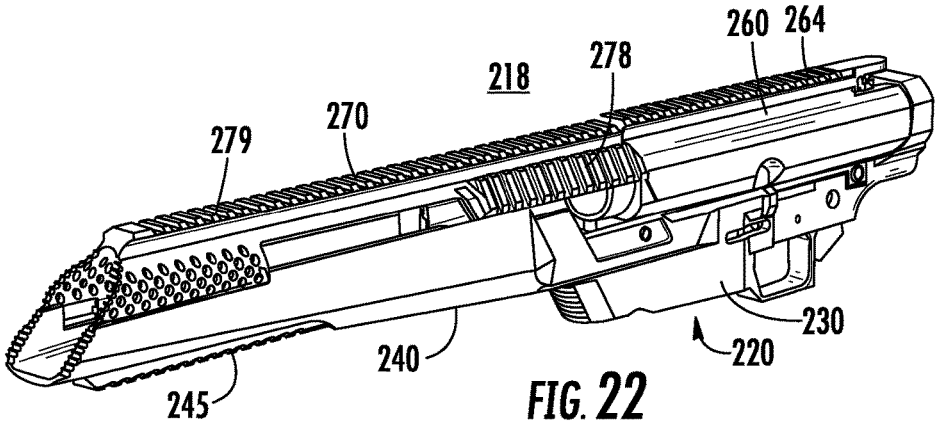
FIG. 22 is a perspective view of the body of FIG. 20.
Figure 23:
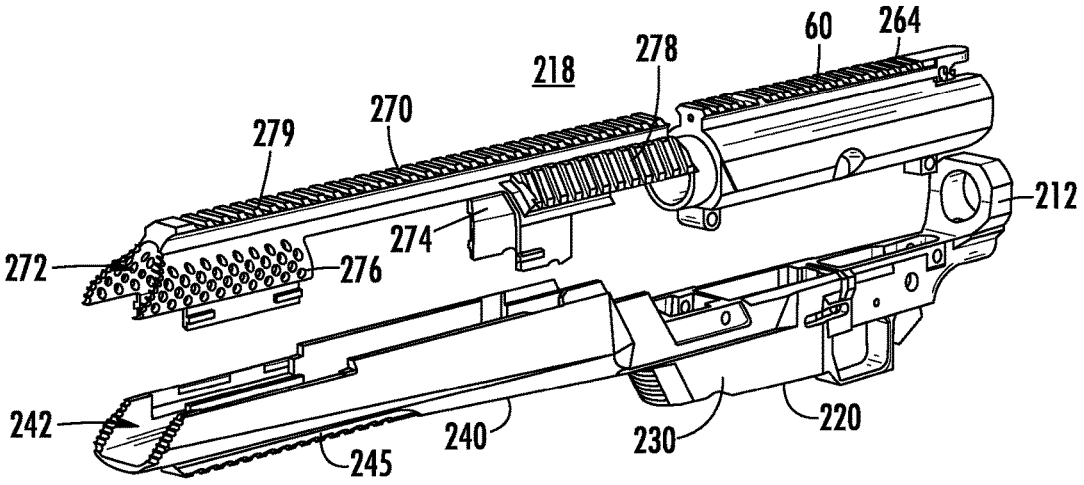
FIG. 23 is a perspective view, with parts separated, of the body of FIG. 20.

With particular reference to FIGS. 17-19, the upper forend 270 is configured to integrally join with the lower chassis 220 over the lower forend 240. The upper forend 270 has a pair of proximal legs 274 and a pair of distal legs 276 which are each laterally spaced apart to define an upper channel 272 therebetween. The pair of proximal legs 274 and the pair of distal legs 276 are longitudinally spaced apart from one another along the upper channel 272. Each of the proximal legs 274 and distal legs 276 may include a lower mounting surface 275, 277 that is secured to the lower forend 240. The lower mounting surfaces 275, 277 may receive a fastener to secure each of the proximal and distal legs 274, 276 to the lower forend 240. In some embodiments, the each of the lower mounting surfaces 275, 277 include a portion of a fastening system, e.g., a portion of a slide lock, that interfaces with another portion of the fastening system on the lower forend 240 to secure the upper forend 270 with the lower forend 240 of the lower chassis 220. In some embodiments, the lower mounting surfaces 275, 277 are welded to the lower forend 240.

In embodiments, the upper forend 270 is monolithically formed with the lower forend 240 of the lower chassis 220. When the upper forend 270 is monolithically formed with the lower forend 240, the proximal and distal legs 274, 276 may not extend into the lower forend 240 and be formed with the lower forend 240 along a center line of the channel 242.

The upper channel 272 may form a portion of the channel 242 and receive a portion of a barrel, e.g., barrel 290 (FIG. 10). The upper forend 270 may include a top rail 279 that extends along a length of an upper surface thereof. The top rail 279 may extend along a substantial or entire length of the upper surface of the upper forend 270. The proximal legs 274 may include angled surfaces which include an angled rail 278. The angled rail 278 extends in a direction parallel to a longitudinal axis of the upper channel 272 and is radially offset to the top rail 279 at an angle in a range of about 15 degrees to about 90 degrees about the longitudinal axis of the upper channel 272. As shown in FIG. 18, the angled rail 278 is offset about 30 degrees from the top rail 279. The upper forend 270 may include an angled rail 278 on one or both of the proximal legs 274. In some embodiments, the upper forend 70 is provided without an angled rail 278. In other embodiments, the upper forend 70 includes an angled rail 278 on each of the proximal and distal legs 272, 274. In certain embodiments, the upper forend 270 includes an angled rail 278 that is continuous from a proximal leg 274 to a distal leg 276. In particular embodiments, one or more of the proximal legs 274 includes an angled rail 278 offset at a first angle, e.g., about 45 degrees, and one or more of the distal legs 276 includes an angled rail 278 offset at a second angle, e.g., about 90 degrees, that is different from the first angle.

With additional reference to FIGS. 20-24, the lower chassis 220, the upper carrier 260, and the upper forend 270 form a body 218 for a firearm, e.g., firearm 200 (FIG. 10). The lower chassis 220 and the upper forend 270 may be monolithically or integrally formed with one another. In some embodiments, the upper carrier 260 and the upper forend 270 are monolithically or integrally formed with one another. In embodiments, the lower chassis 220, the upper carrier 260, and the upper forend 270 are monolithically or integrally formed with one another.

Figure 24:
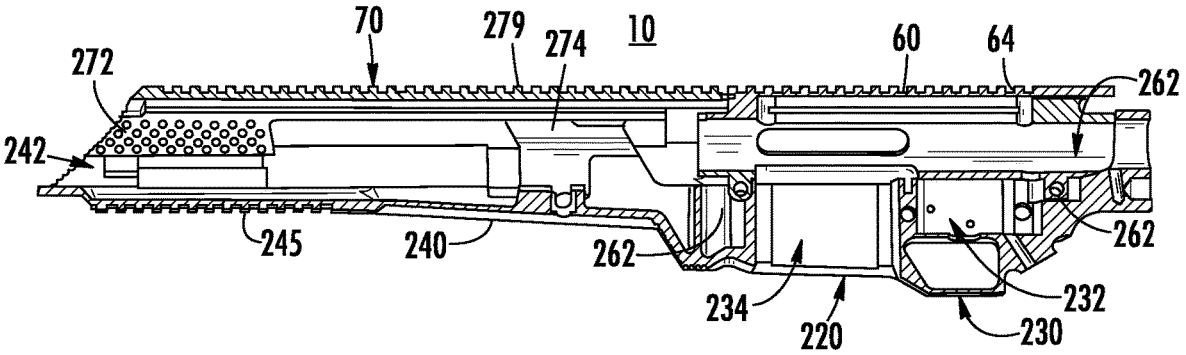
FIG. 24 is a side cross-sectional view of the body of FIG. 20.

With particular reference to FIG. 24, the upper carrier 260 secures over the trigger well 232 and the magazine well 234 of the lower chassis 220. The upper carrier 260 may partially receive a portion of an action therein, e.g., action 283 (FIG. 11). For example, as shown in FIG. 11, a bolt carrier 280 may be received within the upper carrier 260. The upper carrier 260 may be secured to the lower receiver 230 of the lower chassis 220 by one or more fasteners passing through legs or tabs 262 of the upper carrier 260. The upper carrier 260 may also include an upper rail 264 that extends along an upper surface of the upper carrier 260. The upper rail 264 may form a continuous rail with the top rail 279 of the upper forend 270. While not shown, the upper carrier 260 may include one more angled rails similar to the angled rails 278 detailed above.

The body 218 may include a plurality of rails as detailed individually above. For example, the lower chassis 220 may include the lower rail 245, the upper carrier 260 may include an upper rail 264, and the upper forend 270 may include one or more angled rails 278 and an upper rail 279. The rails 245, 264, 278, 279 may be used to mount one or more accessories to the firearm 200, e.g., light 292 or scope 294 (FIG. 10). The upper rails 264, 279 may form a single continuous rail with a portion of a single accessory being mounted or secured to each of the upper rails 264, 279.

Figure 25:
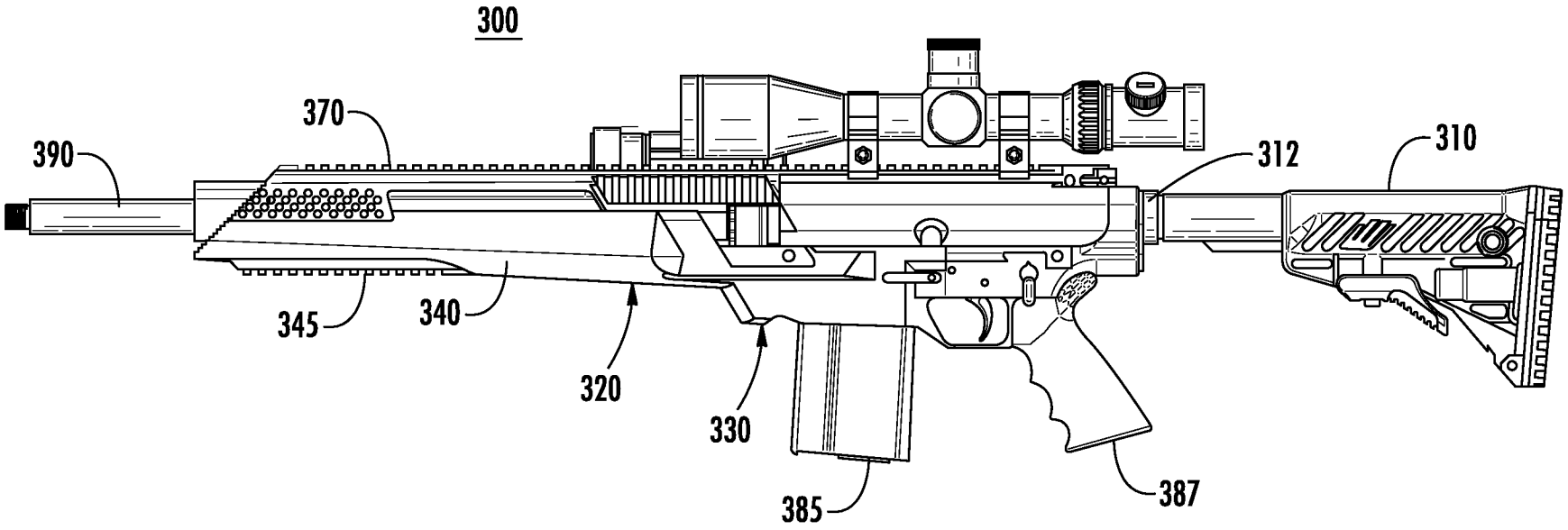
FIG. 25 is a side view of another firearm provided in accordance with the present disclosure.
Figure 26:
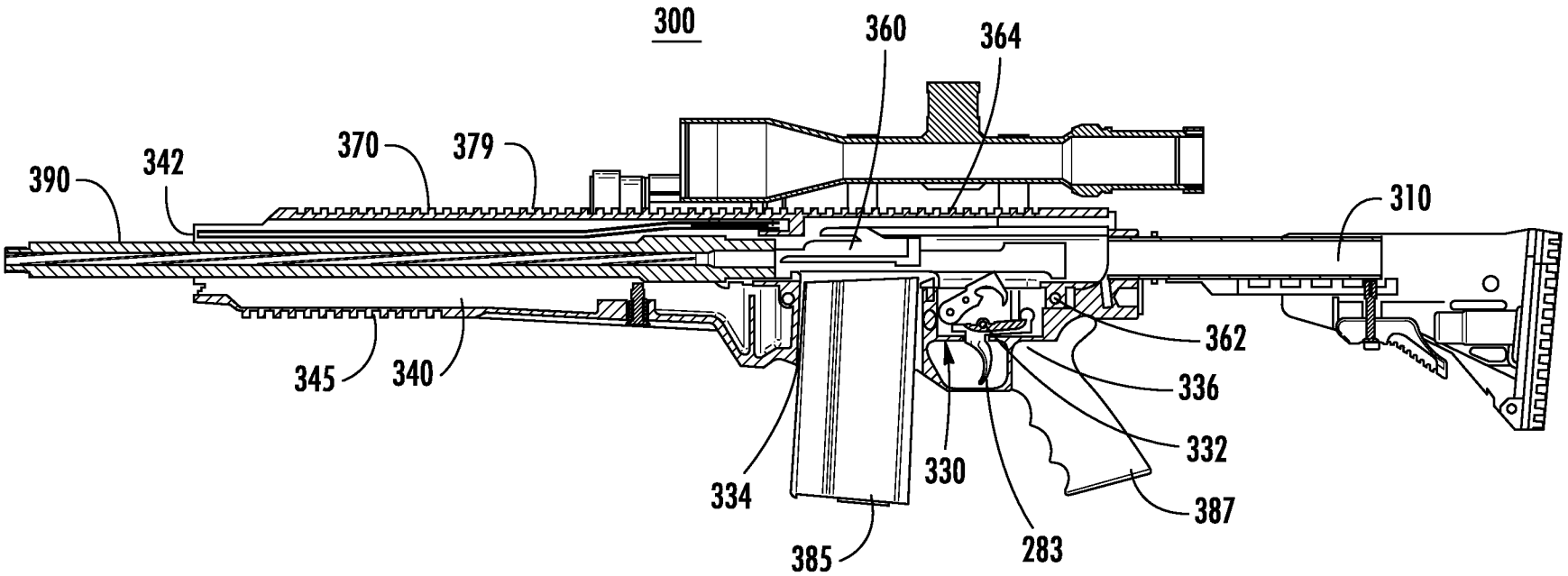
FIG. 26 is a side cross-sectional view of the firearm of FIG. 25.

With reference to FIGS. 25 and 26, another firearm 300 is provided in accordance with the present disclosure. The firearm 300 includes several components that are similar to the components of firearm 200 detailed above with similar components having similar labels with a "3" replacing the "2" of the previous label, e.g., the upper carrier 360 of firearm 300 is similar to the upper carrier 260 of firearm 200. For reasons of brevity only the differences between firearm 300 and firearm 200 will be detailed below.

The firearm 300 includes a lower chassis 320 monolithically formed with an upper forend 370 which define a channel 342 therebetween to receive a barrel 390. The upper carrier 360 is secured to the lower chassis 320 by fasteners passed through tabs 362 as shown in FIG. 25. An action 383 is disposed within a trigger well 333 of a lower receiver 330 of the lower chassis 320 before the upper carrier 360 is secured thereto. The fire arm 300 also includes a magazine 385, a pistol grip 387, and a stock 310.

The components for firearms, e.g., firearms 200, 300 detailed above, e.g., lower chassis 220, 320, may be used with a variety of firearms including, but not limited to, bolt action firearms, shotguns, semi-automatic firearms, pistols, or fully automatic firearms.

While several embodiments of the disclosure have been shown in the drawings, it is not intended that the disclosure be limited thereto, as it is intended that the disclosure be as broad in scope as the art will allow and that the specification be read likewise. Any combination of the above embodiments is also envisioned and is within the scope of the appended claims. Therefore, the above description should not be construed as limiting, but merely as exemplifications of particular embodiments. Those skilled in the art will envision other modifications within the scope of the claims appended hereto.

What is claimed:

1. A chassis of a registered, semi-automatic firearm, the chassis comprising:

a lower receiver defining a trigger well configured to receive an action; and a lower forend extending distally from and monolithically formed with the lower receiver, the lower forend defining a channel configured to receive a barrel, wherein the lower forend is configured to be spaced from the barrel to define an annular gap between the lower forend and the barrel, the annular gap extending along the length of the lower forend.

2. The chassis according to claim 1, further comprising a lower rail secured to a lower surface of the lower forend, the lower surface opposite the channel.

3. The chassis according to claim 2, wherein the lower rail is monolithically formed with the lower forend.

4. The chassis according to claim 2, wherein the lower rail extends longitudinally along the lower surface of the lower forend and is configured to secure an accessory to the lower forend in a plurality of longitudinal positions.

5. The chassis according to claim 1, further comprising an upper forend secured to the lower forend, a portion of the channel defined between the upper and lower forends.

6. The chassis according to claim 5, further comprising an upper rail disposed on an upper surface of the upper forend opposite the channel.

7. The chassis according to claim 6, wherein the upper rail is monolithically formed with the upper forend.

8. The chassis according to claim 5, wherein the upper forend is monolithically formed with the lower forend.

9. The chassis according to claim 1, further comprising a stock mount secured to the lower receiver, the stock mount configured to secure a stock to the lower receiver.

10. The chassis according to claim 9, wherein the stock mount is monolithically formed with the lower receiver.

11. The chassis according to claim 5, further comprising an upper carriage secured to the lower receiver.

12. The chassis according to claim 11, wherein the upper carriage is monolithically formed with the upper forend.

13. The chassis according to claim 1, wherein the lower receiver defines a magazine well configured to receive a magazine containing one or more cartridges suitable for the action.

14. The chassis according to claim 13, wherein the lower forend extends distally from the magazine well.

15. A registered, semi-automatic firearm comprising:

a lower chassis including:

a lower receiver defining a trigger well; and a lower forend extending distally from and monolithically formed with the lower receiver, the lower forend defining a channel;

an action received within the trigger well; and a barrel received within the channel, wherein the barrel is spaced radially inward from the lower forend along the length of the lower forend.

16. The firearm according to claim 15, further comprising a lower rail monolithically formed on a lower surface of the lower forend, the lower surface opposite the channel.

17. The firearm according to claim 15, further comprising an upper forend secured to the lower forend, a portion of the channel defined between the upper and lower forends, wherein the barrel is spaced radially inward from the lower and upper forends to define an annular gap that extends along the entire length of the lower and upper forends.

18. The firearm according to claim 15, further comprising a stock secured to and extending proximally from the lower chassis.

19. The firearm according to claim 15, further comprising an upper carriage secured to the lower receiver.

20. A registered, semi-automatic firearm comprising:

a lower chassis including:

a lower receiver defining a trigger well and a magazine well; and a lower forend extending distally and monolithically formed with the lower receiver;

an upper forend secured to the lower forend with a channel being defined between the upper and lower forends;

an upper carriage secured to the lower receiver over the trigger well to define a chamber;

a stock secured to and extending proximally from the lower receiver;

an action received within the trigger well; and a barrel received within the channel, wherein the barrel is spaced radially inward from the lower and upper forends to define an annular gap that extends along the length of the lower and upper forends.

* * * * *